US010696061B2

(12) United States Patent
Shigeta

(10) Patent No.: US 10,696,061 B2
(45) Date of Patent: Jun. 30, 2020

(54) INK JET PRINTER AND INK JET PRINTING METHOD USING THE SAME

(71) Applicant: THINK LABORATORY CO., LTD., Chiba (JP)

(72) Inventor: Tatsuo Shigeta, Chiba (JP)

(73) Assignee: THINK LABORATORY CO., LTD., Chiba (JP)

( * ) Notice: Subject to any disclaimer, the term of this patent is extended or adjusted under 35 U.S.C. 154(b) by 0 days.

(21) Appl. No.: 16/467,214

(22) PCT Filed: May 2, 2018

(86) PCT No.: PCT/JP2018/017491
§ 371 (c)(1),
(2) Date: Jun. 6, 2019

(87) PCT Pub. No.: WO2018/211987
PCT Pub. Date: Nov. 22, 2018

(65) Prior Publication Data

US 2020/0079104 A1 Mar. 12, 2020

(30) Foreign Application Priority Data

May 19, 2017 (JP) ..... 2017-099427

(51) Int. Cl.
*B41J 2/21* (2006.01)
*B41J 11/00* (2006.01)
(Continued)

(52) U.S. Cl.
CPC ..... *B41J 2/2117* (2013.01); *B41J 2/01* (2013.01); *B41J 2/21* (2013.01); *B41J 2/215* (2013.01);
(Continued)

(58) Field of Classification Search
CPC ..... B41J 2/01; B41J 2/21; B41J 2/2114; B41J 2/2117; B41J 2/215; B41J 11/02; B41M 5/00; B41M 7/009
See application file for complete search history.

(56) References Cited

U.S. PATENT DOCUMENTS 6,068,374 A * 5/2000 Kurata ..... B41J 3/4078 347/100
7,399,048 B2 * 7/2008 Inoue ..... B41J 29/393 347/16
(Continued)

FOREIGN PATENT DOCUMENTS

CA 2918390 A1 1/2015
JP 2004-306591 A 11/2004
(Continued)

*Primary Examiner* — Anh T Vo
(74) *Attorney, Agent, or Firm* — McGlew and Tuttle, P.C.

(57) ABSTRACT

An ink jet printer, for both back-surface printing and front-surface printing, forms an image with aqueous ink on a web-shaped printing base material by any of the back-surface printing and the front-surface printing. An ink jet printing method uses the ink jet printer. The ink jet printer includes: a conveyance mechanism configured to continuously convey the web-shaped printing base material in forward and reverse directions; a single-pass system ink jet head configured to discharge white aqueous ink to a surface of the web-shaped printing base material conveyed by the conveyance mechanism; a single-pass system ink jet head configured to discharge non-white aqueous ink to the surface of the web-shaped printing base material conveyed by the conveyance mechanism; and a white ink drying device with a drying zone for drying the surface of the web-shaped printing base material having the white aqueous ink adhering thereto.

3 Claims, 3 Drawing Sheets

(51) Int. Cl.

| | |
|---|---|
| ***B41M 7/00*** | (2006.01) |
| ***B41J 2/215*** | (2006.01) |
| ***B41J 2/01*** | (2006.01) |
| ***B41M 5/00*** | (2006.01) |

(52) U.S. Cl.
CPC ..... *B41J 2/2114* (2013.01); *B41J 11/002* (2013.01); *B41M 5/00* (2013.01); *B41M 7/009* (2013.01)

(56) References Cited

U.S. PATENT DOCUMENTS

| | | | | |
|---|---|---|---|---|
| 8,454,152 | B2 * | 6/2013 | Kobayashi | B41J 11/002 347/102 |
| 8,523,320 | B2 * | 9/2013 | Nagoshi | B41J 2/2146 347/40 |
| 2004/0189772 | A1 | 9/2004 | Arai | |
| 2011/0109673 | A1 | 5/2011 | Usuda et al. | |
| 2015/0030823 | A1 | 1/2015 | Stamatoukos et al. | |
| 2016/0129702 | A1 | 5/2016 | Katagami et al. | |

FOREIGN PATENT DOCUMENTS

| | | | |
|---|---|---|---|
| JP | 2010-142966 | A | 7/2010 |
| JP | 2011-116104 | A | 6/2011 |
| JP | 2012-24932 | A | 2/2012 |
| JP | 2012-148576 | A | 8/2012 |
| JP | 2014-214160 | A | 11/2014 |
| JP | 2015-155209 | A | 8/2015 |
| JP | 2016-88026 | A | 5/2016 |
| WO | 2015/013391 | A1 | 1/2015 |

* cited by examiner

INK JET PRINTER AND INK JET PRINTING METHOD USING THE SAME

TECHNICAL FIELD

The present invention relates to an ink jet printer which is configured to perform single-pass system image formation with aqueous ink on a web-shaped printing base material, and an ink jet printing method using the ink jet printer.

BACKGROUND ART

Hitherto, as a method of performing ink jet printing with aqueous ink on a printing base material through use of an ink jet printer, there has been proposed a method of performing printing while heating the printing base material being conveyed (Patent Document 1).

As a method of heating the printing base material being conveyed as described above, there has been employed a method of heating a back surface of the printing base material through use of a hot plate or the like.

However, even when the back surface of the printing base material is heated through use of the hot plate or the like, there arises the following problem in a case of performing printing while continuously conveying the printing base material. That is, when a printing speed reaches a speed of about 15 m/min, ink flow and color blurring caused by insufficient drying of ink and the like, color mixing during multicolor printing, and the like occur. In particular, when white color is printed, there is a problem in that a larger amount of ink is required as compared to other colors, and hence the ink is not dried easily.

Further, as methods of performing printing while continuously conveying the printing base material, there are given a scan system and a single-pass system. Of those systems, the single-pass system is more suitable for high-speed printing because the single-pass system does not require scanning. A single-pass system ink jet recording method is disclosed, for example, in Patent Document 2. However, as described above, there is a problem in that, when the printing speed reaches a speed of about 15 m/min, ink flow and color blurring caused by insufficient drying of ink and the like, color mixing during multicolor printing, and the like occur. In particular, when white color is printed, there is a problem in that a larger amount of ink is required as compared to other colors, and hence the ink is not dried easily, with the result that the printing speed cannot be increased easily.

Meanwhile, as methods of performing printing on a web-shaped printing base material by a single-pass system, there are given back-surface printing and front-surface printing depending on the application.

When printing is performed on a transparent web-shaped printing base material, such as a web-shaped synthetic resin film, the back-surface printing is suitable. In the case of the back-surface printing, white color (W) is printed on a printing surface side after printing of each color (black (K), cyan (C), magenta (M), yellow (Y), and the like) is performed.

When printing is performed on an opaque web-shaped printing base material, such as web-shaped paper or non-woven fabric, the front-surface printing is performed. In the case of the front-surface printing, printing of each color (black (K), cyan (C), magenta (M), yellow (Y), and the like) is performed after white color (W) is printed on a printing surface side.

In the related art, an ink jet printer dedicated to the back-surface printing, which is configured to perform the back-surface printing on a web-shaped printing base material by a single-pass system, and an ink jet printer dedicated to the front-surface printing, which is configured to perform the front-surface printing on a web-shaped printing base material by a single-pass system, are separately prepared, and the back-surface printing and the front-surface printing are performed by the ink jet printers, respectively.

However, when the ink jet printer dedicated to the back-surface printing and the ink jet printer dedicated to the front-surface printing, which is configured to perform the front-surface printing, are separately prepared, facility cost and installation areas are required correspondingly. Therefore, there has been a demand for the emergence of an ink jet printer capable of performing the back-surface printing and the front-surface printing on a web-shaped printing base material by a single-pass system.

PRIOR ART DOCUMENTS

Patent Documents

Patent Document 1: JP 2014-214160 A
Patent Document 2: JP 2010-142966 A

DISCLOSURE OF THE INVENTION

Problems to be Solved by the Invention

An object of the present invention is to provide an ink jet printer for both back-surface printing and front-surface printing, which is capable of forming an image with aqueous ink on a web-shaped printing base material by any of the back-surface printing and the front-surface printing, and an ink jet printing method using the ink jet printer.

Means for Solving Problems

In order to solve the above-mentioned problems, an ink jet printer for both front-surface printing and back-surface printing according to the present invention is configured to perform image formation by discharging aqueous ink to a web-shaped printing base material by a single-pass system, and includes: a conveyance mechanism configured to continuously convey the web-shaped printing base material in forward and reverse directions; a single-pass system ink jet head configured to discharge white aqueous ink to a surface of the web-shaped printing base material conveyed by the conveyance mechanism; a single-pass system ink jet head configured to discharge non-white aqueous ink to the surface of the web-shaped printing base material conveyed by the conveyance mechanism; and a white ink drying device, which has a carry-in port for conveying the web-shaped printing base material having the white aqueous ink adhering thereto to the white ink drying device and a carry-out port for conveying the web-shaped printing base material having the white aqueous ink adhering thereto out from the white ink drying device, and has a drying zone for drying the surface of the web-shaped printing base material having the white aqueous ink adhering thereto, wherein, in the case of back-surface printing, the white aqueous ink is dried by causing the web-shaped printing base material, which has the white aqueous ink adhering thereto and has been conveyed in the forward direction, to pass through the white ink drying device, and wherein, in the case of front-surface printing, the white aqueous ink is dried by causing the web-shaped printing base material, which has the white aqueous ink adhering thereto and has been conveyed in the reverse direction, to pass through the white ink drying device.

In printing by the ink jet printer, a digital image is formed through use of a dot group of discharged ink drops, and hence the image formation refers to formation of a digital image through use of the dot group of the discharged ink drops.

According to a first embodiment of an ink jet printing method according to the present invention, the ink jet printing method includes, through use of the said ink jet printer, drying the white aqueous ink to perform back-surface printing with aqueous ink on the web-shaped printing base material by a single-pass system.

According to a second embodiment of the ink jet printing method according to the present invention, the ink jet printing method includes, through use of the said ink jet printer, drying the white aqueous ink to perform front-surface printing with aqueous ink on the web-shaped printing base material by a single-pass system.

As the web-shaped printing base material, an opaque web-shaped printing base material, such as paper or non-woven fabric, as well as a transparent film, can be used. As the web-shaped printing base material being the transparent film, a transparent film using a web-shaped synthetic resin film made of polyethylene terephthalate (PET), polyvinyl chloride (PVC), polypropylene (PP), or the like may be suitably used. When printing is performed on the transparent web-shaped printing base material, such as the web-shaped synthetic resin film, the back-surface printing is suitable. When printing is performed on the opaque web-shaped printing base material, such as the web-shaped paper or non-woven fabric, the front-surface printing is performed.

Advantageous Effects of the Invention

The present invention exhibits the remarkable effect capable of providing an ink jet printer for both the back-surface printing and the front-surface printing, which is capable of forming an image with aqueous ink on a web-shaped printing base material by any of the back-surface printing and the front-surface printing, and an ink jet printing method using the ink jet printer.

DESCRIPTION OF EMBODIMENTS

Embodiments of the present invention are described below, but those embodiments are described as examples, and hence it is understood that various modifications may be made thereto without departing from the technical spirit of the present invention. In addition, the same members are denoted by the same reference symbols.

Figure 1:
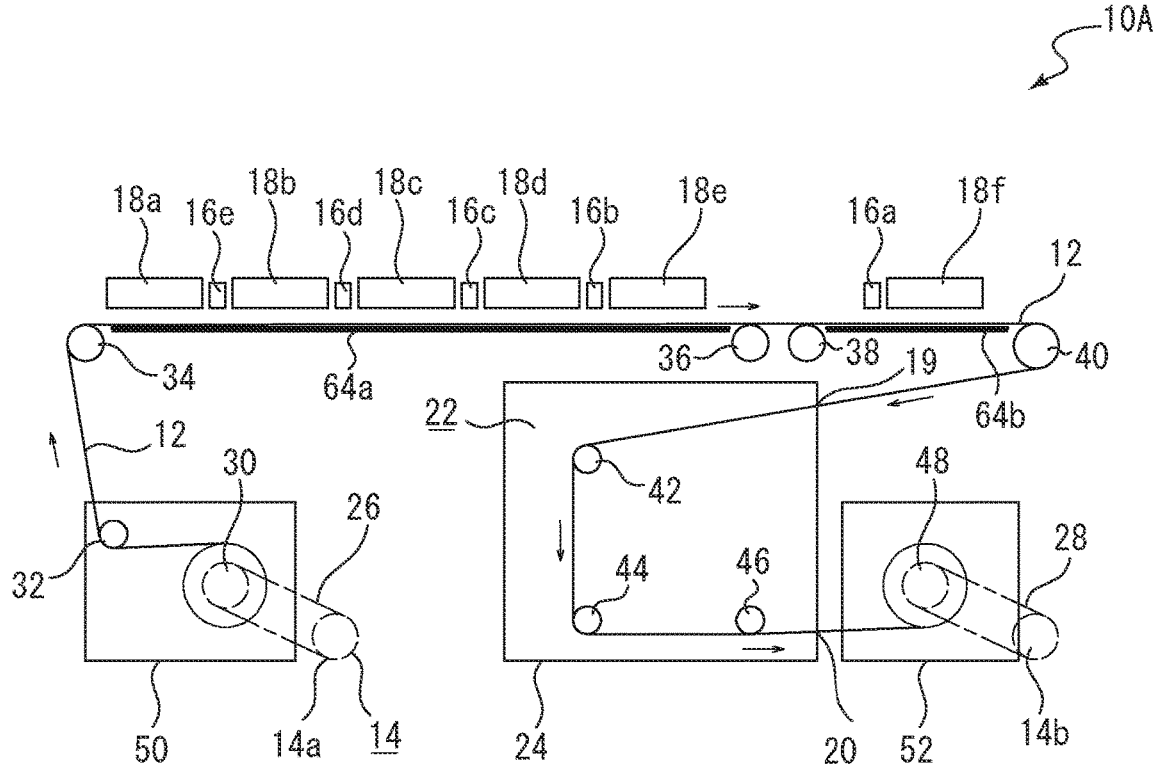
FIG. 1 is a sectional structure explanatory view for illustrating one embodiment of an ink jet printer according to the present invention, and is an illustration of a case in which back-surface printing is performed.

FIG. 1 is a sectional structure explanatory view for illustrating one embodiment of an ink jet printer according to the present invention. In FIG. 1, there is illustrated an ink jet printer 10A of the present invention.

The ink jet printer 10A is configured to perform image formation by discharging aqueous ink to a web-shaped printing base material 12 by a single-pass system. The ink jet printer 10A includes a conveyance mechanism 14 (conveyance mechanisms 14*a* and 14*b* in the illustrated example), a single-pass system ink jet head 16*a*, single-pass system ink jet heads 16*b* to 16*e*, and a white ink drying device 24. The conveyance mechanism 14 is configured to continuously convey the web-shaped printing base material 12 in forward and reverse directions. The single-pass system ink jet head 16*a* is configured to discharge white aqueous ink to a surface of the web-shaped printing base material 12 conveyed by the conveyance mechanism 14. The single-pass system ink jet heads 16*b* to 16*e* are configured to discharge non-white aqueous ink to the surface of the web-shaped printing base material 12 conveyed by the conveyance mechanism 14. The white ink drying device 24 has carry-in ports 19 and 56 for conveying the web-shaped printing base material 12 having the white aqueous ink adhering thereto to the white ink drying device 24 and carry-out ports 20 and 54 for conveying the web-shaped printing base material 12 having the white aqueous ink adhering thereto out from the white ink drying device 24, and has a drying zone 22 for drying the surface of the web-shaped printing base material 12 having the white aqueous ink adhering thereto.

In the case of back-surface printing by the ink jet printer 10A, the web-shaped printing base material 12 is conveyed in the forward direction (arrow direction of FIG. 1) by the conveyance mechanism 14. The web-shaped printing base material 12, which has the white aqueous ink adhering thereto and has been conveyed, is caused to pass through the white ink drying device 24. Meanwhile, in the case of front-surface printing by the ink jet printer 10A, the web-shaped printing base material 12 is conveyed in the reverse direction (arrow direction of FIG. 2) by the conveyance mechanism 14. The web-shaped printing base material 12, which has the white aqueous ink adhering thereto and has been conveyed, is caused to pass through the white ink drying device 24. Thus, the white aqueous ink is dried. That is, the ink jet printer 10A is an ink jet printer for both the back-surface printing and the front-surface printing.

As described above, in the ink jet printer 10A of the present invention, after white aqueous ink which is required to be used in a larger amount as compared to other colors is discharged from the ink jet head 16*a* to the web-shaped printing base material 12, the web-shaped printing base material 12 is caused to pass through the white ink drying device 24. Therefore, the surface of the web-shaped printing base material 12 can be dried before subsequent non-white aqueous ink is discharged from the ink jet heads 16*b* to 16*e*.

Figure 3:
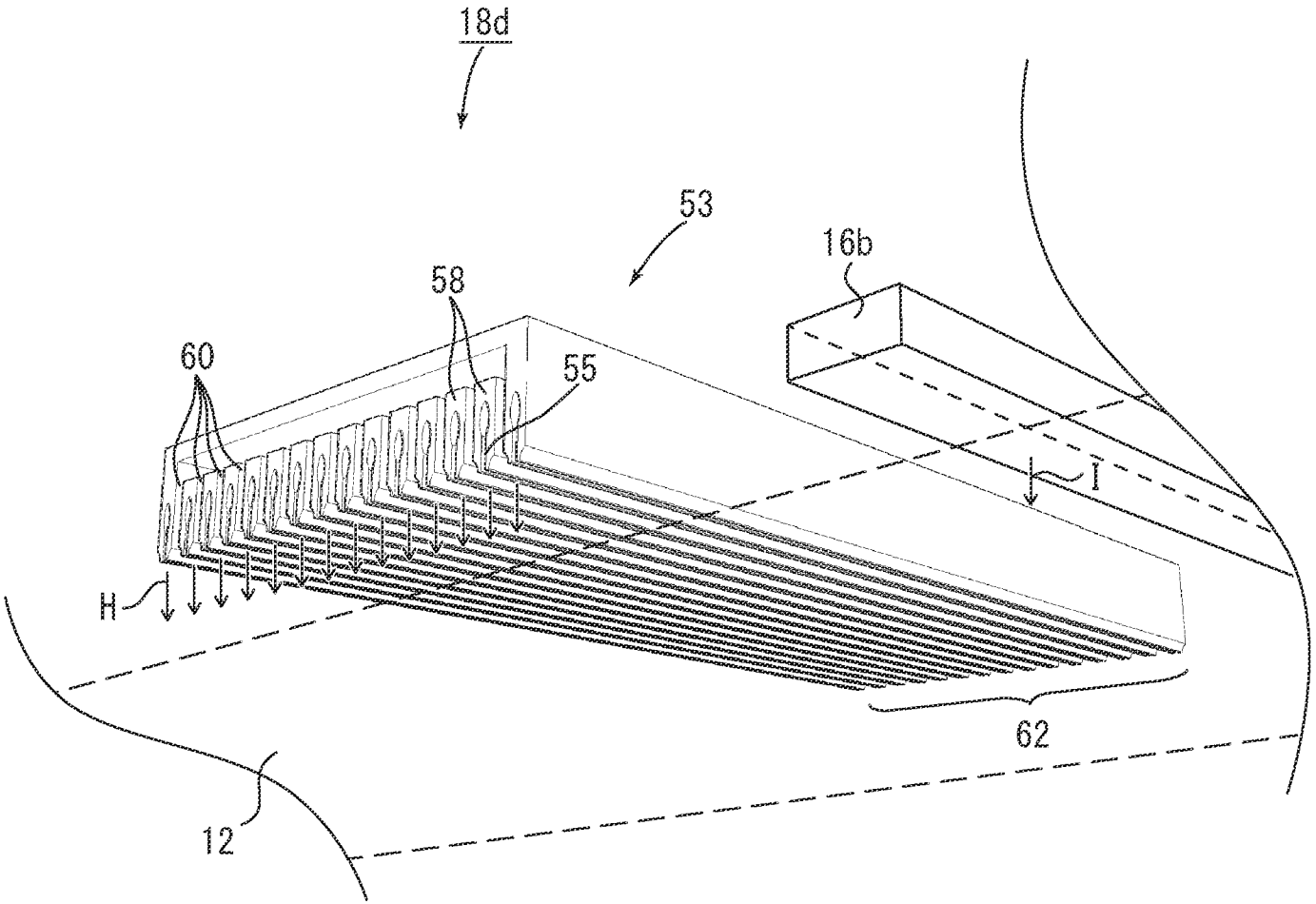
FIG. 3 is a perspective view for illustrating a state of an embodiment of hot air blowing means when viewed obliquely from below.

Further, the ink jet printer 10A includes surface heating units 18*a* to 18*f* configured to heat at least the surface of the web-shaped printing base material 12. As illustrated in FIG. 3, the surface heating units 18*a* to 18*f* are each arranged side by side in the vicinity of the ink jet heads 16*a* to 16*e*. As illustrated in FIG. 1, in the case of the back-surface printing by the ink jet printer 10A, the web-shaped printing base material 12 is conveyed in the forward direction (arrow direction of FIG. 1) by the conveyance mechanism 14.

Therefore, ink is discharged from the ink jet heads 16*a* to 16*e* to the web-shaped printing base material 12 heated by the surface heating units 18*a* to 18*e* arranged on an upstream side of conveyance from the ink jet heads 16*a* to 16*e*.

Figure 2:
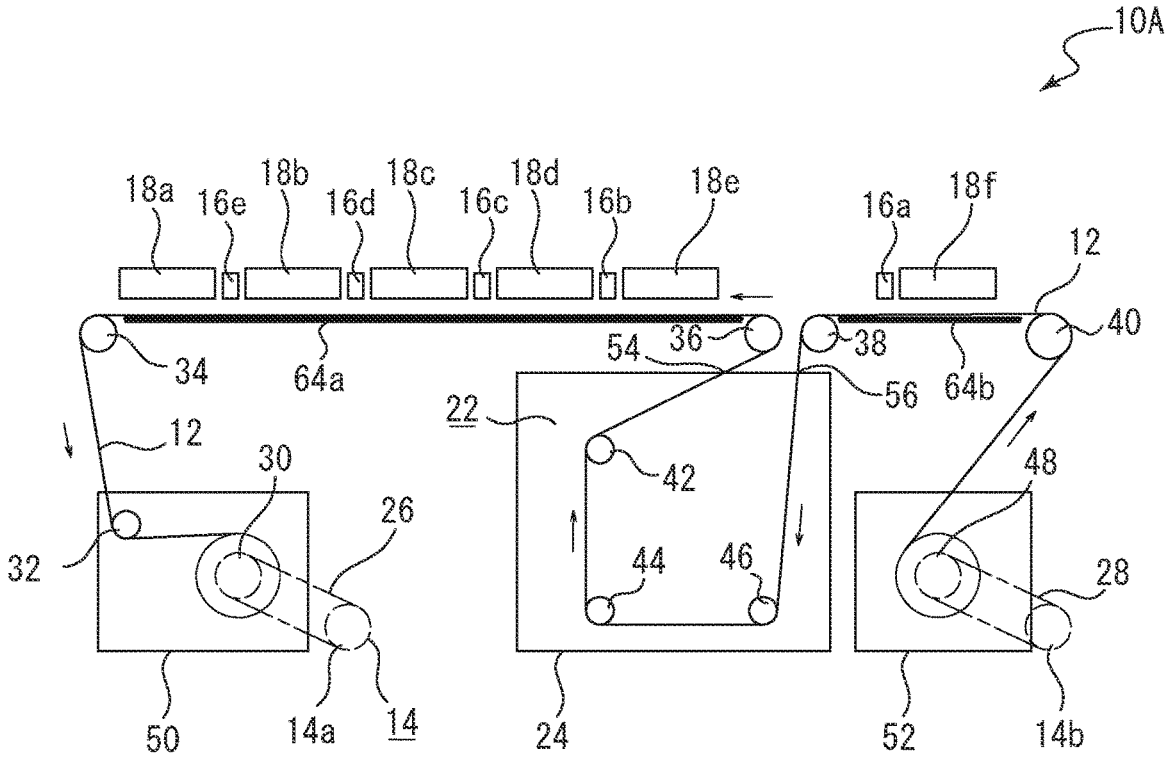
FIG. 2 is a view for illustrating a case in which front-surface printing is performed by the ink jet printer of FIG. 1.

Further, as illustrated in FIG. 2, in the case of the front-surface printing by the ink jet printer 10A, the web-shaped printing base material 12 is conveyed in the reverse direction (arrow direction of FIG. 2) by the conveyance mechanism 14. Therefore, ink is discharged from the ink jet heads 16*a* to 16*e* to the web-shaped printing base material 12 heated by the surface heating units 18*b* to 18*f* arranged on an upstream side of conveyance from the ink jet heads 16*a* to 16*e*. Further, any one of the surface heating units 18*a* to 18*f* is arranged also on a downstream side of conveyance in the forward and reverse directions of the ink jet heads 16*a* to 16*e*. With this, post-drying of aqueous ink discharged from the ink jet heads 16*a* to 16*e* is further accelerated.

As the ink jet heads 16*a* to 16*e*, various known single-pass system ink jet discharge devices can be used.

As the conveyance mechanism 14, any known mechanism can also be used as long as the mechanism can convey the web-shaped printing base material 12 in the forward and reverse directions, and a preferred example is illustrated. In the example of FIG. 1 and FIG. 2, there is illustrated a configuration including drive belts 26 and 28, a winding roller 30, various rollers 32, 34, 36, 38, 40, 42, 44, and 46, and a winding roller 48. The winding roller 30 serves as an original roller around which the web-shaped printing base material 12 is wound during the back-surface printing and a roll-up roller configured to roll up the printed web-shaped printing base material 12 during the front-surface printing. The various rollers 32, 34, 36, 38, 40, 42, 44, and 46 are configured to convey the web-shaped printing base material 12. The winding roller 48 serves as an original roller around which the web-shaped printing base material 12 is wound during the front-surface printing and a roll-up roller configured to roll up the printed web-shaped printing base material 12 during the back-surface printing.

Further, the winding rollers 30 and 48 are accommodated in heating boxes 50 and 52, respectively. When the winding roller 30 serves as the original roller during the back-surface printing, the inside of the heating box 50 is heated in advance (pre-heated) to a temperature of from 60° C. to 70° C. Further, when the winding roller 48 serves as the original roller during the front-surface printing, the inside of the heating box 52 is heated in advance (pre-heated) to a temperature of from 60° C. to 70° C. As a method of heating in the heating boxes 50 and 52, heating may be performed with hot air or by various known heaters. In the illustrated example, there is illustrated a configuration in which the inside of each of the heating boxes 50 and 52 is heated with hot air.

At least the surface of the web-shaped printing base material 12 heated in advance as described above is heated by any one of the surface heating units 18*a* to 18*f* arranged on the upstream side of conveyance from the ink jet heads 16*a* to 16*e*. As the surface heating unit 18*a* to 18*f*, an example is given of hot air blowing means. In the hot air blowing means, hot air at a temperature of from about 40° C. to about 80° C., for example, a temperature of 70° C. is applied to the surface of the web-shaped printing base material 12. A time period for applying hot air is from about 2 seconds to about 3 seconds in the case of a printing speed of 15 m/min, but is appropriately changed also depending on the temperature of the hot air.

An embodiment of the hot air blowing means to be used as the surface heating units 18*a* to 18*f* is illustrated in FIG. 3. As is well illustrated in FIG. 3, as hot air blowing means 53 being the surface heating unit 18*d*, it is possible to adopt a configuration including a nozzle group main body 62 having a plurality of slit-shaped hot air blowing nozzles 58 arranged so as to form gaps 60 therebetween, the slit-shaped hot air blowing nozzles 58 each having a slit-shaped hot air outlet port 55 extending in a width direction of the web-shaped printing base material 12, and a suction mechanism (not shown) configured to suck an atmosphere of the gaps 60 formed in the nozzle group main body 62. The atmosphere of the gaps 60 is sucked in a direction opposite to blowing of hot air H (direction opposite to the arrow of FIG. 3) by the suction mechanism (not shown). As the suction mechanism, various known suction devices can be used, and hence illustration thereof is omitted. Thus, the effect of reducing color blurring and the like caused by aqueous ink I is achieved through suction of the atmosphere of the gaps 60.

In the illustrated example, as the ink jet heads 16*a* to 16*e*, there are used the ink jet head 16*a* for W (white), the ink jet head 16*b* for Y (yellow), the ink jet head 16*c* for M (magenta), the ink jet head 16*d* for C (cyan), and the ink jet head 16*e* for K (black), and ink storage tanks (not shown) are provided for respective colors. Aqueous ink I of respective colors is discharged from the ink jet heads 16*a* to 16*e*.

Further, in the illustrated example, there is illustrated an example in which back surface heating units 64*a* and 64*b* configured to heat the web-shaped printing base material 12 from a back surface thereof are arranged. As the back surface heating units 64*a* and 64*b*, known hot plates can be used, and for example, electrothermal heaters each having a filament laid on a ceramic plate can be used. When the hot plates are used as the back surface heating units 64*a* and 64*b*, it is suitable that the hot plates be used after being heated to a temperature of, for example, from 40° C. to 65° C.

The ink jet printer 10A includes the white ink drying device 24 having the drying zone 22 for drying the surface of the web-shaped printing base material 12 having white aqueous ink adhering thereto.

The white ink drying device 24 has the carry-in ports 19 and 56 for conveying the web-shaped printing base material 12 having the white aqueous ink adhering thereto to the white ink drying device 24 and the carry-out ports 20 and 54 for conveying the web-shaped printing base material 12 having the white aqueous ink adhering thereto out from the white ink drying device 24. That is, in the illustrated example, the white ink drying device 24 has a plurality of carry-in ports and a plurality of carry-out ports, which can be selected to be used in accordance with the printing methods, that is, the back-surface printing and the front-surface printing.

In the case of the back-surface printing illustrated in FIG. 1, the web-shaped printing base material 12 having the white aqueous ink adhering thereto is conveyed to the white ink drying device 24 through the carry-in port 19 and conveyed out from the white ink drying device 24 through the carry-out port 20. Meanwhile, in the case of the front-surface printing illustrated in FIG. 2, the web-shaped printing base material 12 having the white aqueous ink adhering thereto is conveyed to the white ink drying device 24 through the carry-in port 56 and conveyed out from the white ink drying device 24 through the carry-out port 54.

The white ink drying device 24 has a heat insulating hood structure, and a region, in which the web-shaped printing base material 12 is conveyed to the white ink drying device 24 through the carry-in ports 19 and 56 and conveyed out from the white ink drying device 24 through the carry-out ports 20 and 54 through intermediation of the rollers 42, 44, and 46, is defined as the heat insulating drying zone 22. The inside of the white ink drying device 24 is heated to a temperature of from 60° C. to 70° C. As a method of heating in the white ink drying device 24, heating may be performed with hot air or by various known heaters. It is preferred that the white ink drying device 24 have drying ability capable of heating to a temperature of from about 50° C. to about 100° C. With this, while the web-shaped printing base material 12 is conveyed to the white ink drying device 24 through the carry-in ports 19 and 56 and conveyed out from the white ink drying device 24 through the carry-out ports 20 and 54 through intermediation of the rollers 42, 44, and 46, that is, while the web-shaped printing base material 12 is passing through the drying zone 22, the surface of the web-shaped printing base material 12 having the white aqueous ink adhering thereto is dried.

Figure 4:
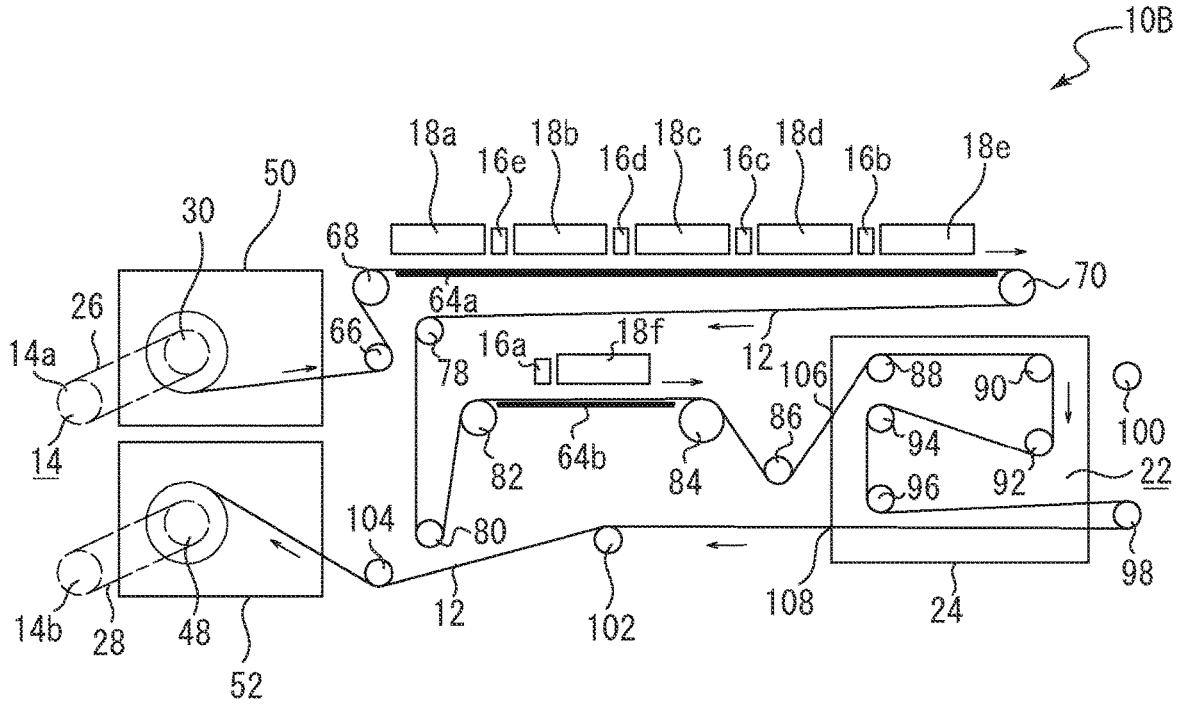
FIG. 4 is a sectional structure explanatory view for illustrating another embodiment of an ink jet printer according to the present invention, and is an illustration of a case in which the back-surface printing is performed.
Figure 5:
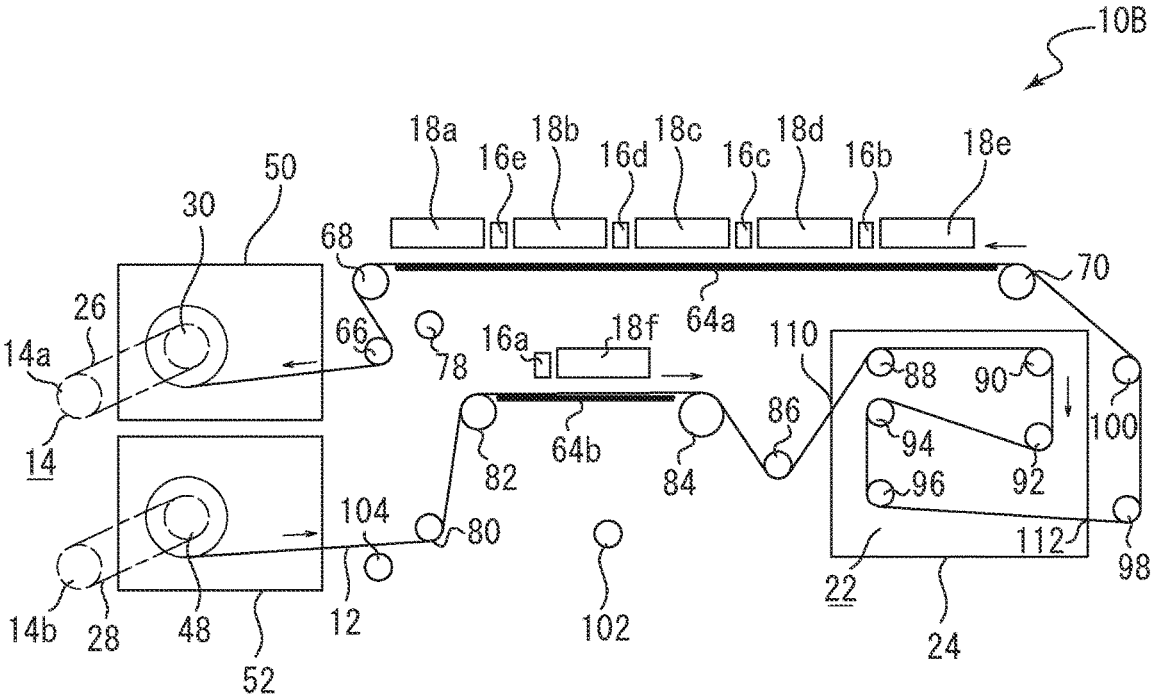
FIG. 5 is a view for illustrating a case in which the front-surface printing is performed by the ink jet printer of FIG. 4.

Next, another embodiment of an ink jet printer according to the present invention is illustrated in FIG. 4 and FIG. 5.

In FIG. 4 and FIG. 5, an ink jet printer 10B is another embodiment of an ink jet printer according to the present invention. The ink jet printer 10B is configured to perform image formation by discharging aqueous ink to a web-shaped printing base material 12 by a single-pass system. The ink jet printer 10B includes a conveyance mechanism 14 (conveyance mechanisms 14*a* and 14*b* in the illustrated example), a single-pass system ink jet head 16*a*, single-pass system ink jet heads 16*b* to 16*e*, and a white ink drying device 24. The conveyance mechanism 14 is configured to continuously convey the web-shaped printing base material 12 in forward and reverse directions. The single-pass system ink jet head 16*a* is configured to discharge white aqueous ink to a surface of the web-shaped printing base material 12 conveyed by the conveyance mechanism 14. The single-pass system ink jet heads 16*b* to 16*e* are configured to discharge non-white aqueous ink to the surface of the web-shaped printing base material 12 conveyed by the conveyance mechanism 14. The white ink drying device 24 has carry-in ports 106 and 110 for conveying the web-shaped printing base material 12 having the white aqueous ink adhering thereto to the white ink drying device 24 and carry-out ports 108 and 112 for conveying the web-shaped printing base material 12 having the white aqueous ink adhering thereto out from the white ink drying device 24, and has a drying zone 22 for drying the surface of the web-shaped printing base material 12 having the white aqueous ink adhering thereto.

In the case of back-surface printing by the ink jet printer 10B, as illustrated in FIG. 4, the web-shaped printing base material 12 is conveyed in the forward direction (arrow direction of FIG. 4) by the conveyance mechanism 14. The web-shaped printing base material 12, which has the white aqueous ink adhering thereto and has been conveyed, is caused to pass through the white ink drying device 24. Meanwhile, in the case of front-surface printing by the ink jet printer 10B, as illustrated in FIG. 5, the web-shaped printing base material 12 is conveyed in the reverse direction (arrow direction of FIG. 5) by the conveyance mechanism 14. The web-shaped printing base material 12, which has the white aqueous ink adhering thereto and has been conveyed, is caused to pass through the white ink drying device 24. Thus, the white aqueous ink is dried. That is, the ink jet printer 10B is an ink jet printer for both the back-surface printing and the front-surface printing.

As described above, in the ink jet printer 10B of the present invention, similarly to the ink jet printer 10A described above, after white aqueous ink which is required to be used in a larger amount as compared to other colors is discharged from the ink jet head 16*a* to the web-shaped printing base material 12, the web-shaped printing base material 12 is caused to pass through the white ink drying device 24. Therefore, the surface of the web-shaped printing base material 12 can be dried before subsequent non-white aqueous ink is discharged from the ink jet heads 16*b* to 16*e*.

The ink jet printer 10B basically has the same configuration as that of the ink jet printer 10A, but is different from the ink jet printer 10A in positions of the conveyance mechanism 14 configured to convey the web-shaped printing base material 12, the winding rollers 30 and 48, and the various rollers 66, 68, 70, 78, 80, 82, 84, 86, 88, 90, 92, 94, 96, 98, 100, 102, and 104, position of the single-pass system ink jet head 16*a* configured to discharge the white aqueous ink, and positions of the white ink drying device 24 and carry-in ports 106 and 110 of the white ink drying device 24 for conveying the web-shaped printing base material 12 having the white aqueous ink adhering thereto to the white ink drying device 24 and carry-out ports 108 and 112 of the white ink drying device 24 for carrying the web-shaped printing base material 12 having the white aqueous ink adhering thereto out from the white ink drying device 24.

In the ink jet printer 10B, there are provided the rollers 88, 90, 92, 94, and 96 in the white ink drying device 24, and the roller 98 is arranged outside the white ink drying device 24. Therefore, in the case of the back-surface printing illustrated in FIG. 4, the web-shaped printing base material 12 having the white aqueous ink adhering thereto is conveyed to the white ink drying device 24 having a heat insulating hood structure through the carry-in port 106 and then returned through intermediation of the roller 98 to be conveyed out from the white ink drying device 24 through the carry-out port 108. As described above, in FIG. 4, the web-shaped printing base material 12 having the white aqueous ink adhering thereto is conveyed in the white ink drying device 24 through the carry-in port 106 and conveyed out from the white ink drying device 24 through the carry-out port 108. In the white ink drying device 24 that is basically set to the heat insulating drying zone 22, the web-shaped printing base material 12 having the white aqueous ink adhering thereto passes through the drying zone 22 through intermediation of the plurality of rollers. Therefore, even when the web-shaped printing base material 12 having the white aqueous ink adhering thereto comes out from the white ink drying device 24 for a short time period, sufficient drying ability is exhibited in the drying zone 22.

In the case of the front-surface printing illustrated in FIG. 5, the web-shaped printing base material 12 having the white aqueous ink adhering thereto is conveyed in the white ink drying device 24 having a heat insulating hood structure through the carry-in port 110 and then conveyed out from the white ink drying device 24 through the carry-out port 112 through intermediation of the rollers 88, 90, 92, 94, and 96. Thus, also in the case of the front-surface printing illustrated in FIG. 5, the heat insulating drying zone 22 is used.

When the white aqueous ink is dried to perform the back-surface printing with aqueous ink on the web-shaped printing base material 12 by a single-pass system through use of the ink jet printer 10A or the ink jet printer 10B having the above-mentioned configuration, the ink jet printing method of the present invention can be achieved.

Further, when the white aqueous ink is dried to perform the front-surface printing with aqueous ink on the web-shaped printing base material 12 by a single-pass system through use of the ink jet printer 10A or the ink jet printer 10B having the above-mentioned configuration, the ink jet printing method of the present invention can be achieved.

As described above, in the present invention, with one ink jet printer 10A or ink jet printer 10B, an image can be formed with aqueous ink on the web-shaped printing base material by any of the back-surface printing and the front-surface printing.

REFERENCE SIGNS LIST

10A, 10B: ink jet printer, 12: web-shaped printing base material, 14, 14*a*, 14*b*: conveyance mechanism, 16*a* to 16*e*: single-pass system ink jet head, 18*a* to 18*f*: surface heating unit, 19, 56, 106, 110: carry-in port, 20, 54, 108, 112: carry-out port, 22: drying zone, 24: white ink drying device, 26, 28: drive belt, 30, 48: winding roller, 32, 34, 36, 38, 40, 42, 44, 46, 66, 68, 70, 78, 80, 82, 84, 86, 88, 90, 92, 94, 96, 98, 100, 102, 104: roller, 50, 52: heating box, 53: hot air blowing means, 55: hot air outlet port, 58: slit-shaped hot air blowing nozzle, 60: gap, 62: nozzle group main body, 64*a*, 64*b*: back surface heating unit, H: hot air, I: aqueous ink.

The invention claimed is:

1. An ink jet printer for both front-surface printing and back-surface printing, which is configured to perform image formation by discharging aqueous ink to a web-shaped printing base material by a single-pass system, comprising:

a conveyance mechanism configured to continuously convey the web-shaped printing base material in forward and reverse directions;

a single-pass system ink jet head configured to discharge white aqueous ink to a surface of the web-shaped printing base material conveyed by the conveyance mechanism;

a single-pass system ink jet head configured to discharge non-white aqueous ink to the surface of the web-shaped printing base material conveyed by the conveyance mechanism; and a white ink drying device, which has a carry-in port for conveying the web-shaped printing base material having the white aqueous ink adhering thereto to the white ink drying device and a carry-out port for conveying the web-shaped printing base material having the white aqueous ink adhering thereto out from the white ink drying device, and has a drying zone for drying the surface of the web-shaped printing base material having the white aqueous ink adhering thereto, wherein, in the case of back-surface printing, the white aqueous ink is dried by causing the web-shaped printing base material, which has the white aqueous ink adhering thereto and has been conveyed in the forward direction, to pass through the white ink drying device, and wherein, in the case of front-surface printing, the white aqueous ink is dried by causing the web-shaped printing base material, which has the white aqueous ink adhering thereto and has been conveyed in the reverse direction, to pass through the white ink drying device.

2. An ink jet printing method, the method comprising the steps of:

providing an ink jet printer for both front-surface printing and back-surface printing, which is configured to perform image formation by discharging aqueous ink to a web-shaped printing base material by a single-pass system, the provided ink jet printer comprising: a conveyance mechanism configured to continuously convey the web-shaped printing base material in forward and reverse directions; a single-pass system ink jet head configured to discharge white aqueous ink to a surface of the web-shaped printing base material conveyed by the conveyance mechanism; a single-pass system ink jet head configured to discharge non-white aqueous ink to the surface of the web-shaped printing base material conveyed by the conveyance mechanism; and a white ink drying device, which has a carry-in port for conveying the web-shaped printing base material having the white aqueous ink adhering thereto to the white ink drying device and a carry-out port for conveying the web-shaped printing base material having the white aqueous ink adhering thereto out from the white ink drying device, and has a drying zone for drying the surface of the web-shaped printing base material having the white aqueous ink adhering thereto, wherein, in the case of back-surface printing, the white aqueous ink is dried by causing the web-shaped printing base material, which has the white aqueous ink adhering thereto and has been conveyed in the forward direction, to pass through the white ink drying device, and wherein, in the case of front-surface printing, the white aqueous ink is dried by causing the web-shaped printing base material, which has the white aqueous ink adhering thereto and has been conveyed in the reverse direction, to pass through the white ink drying device; and with the provided ink jet printer, drying the white aqueous ink to perform back-surface printing with aqueous ink on the web-shaped printing base material by a single-pass system.

3. An ink jet printing method, the method comprising the steps of:

providing an ink jet printer for both front-surface printing and back-surface printing, which is configured to perform image formation by discharging aqueous ink to a web-shaped printing base material by a single-pass system, the provided ink jet printer comprising: a conveyance mechanism configured to continuously convey the web-shaped printing base material in forward and reverse directions; a single-pass system ink jet head configured to discharge white aqueous ink to a surface of the web-shaped printing base material conveyed by the conveyance mechanism; a single-pass system ink jet head configured to discharge non-white aqueous ink to the surface of the web-shaped printing base material conveyed by the conveyance mechanism; and a white ink drying device, which has a carry-in port for conveying the web-shaped printing base material having the white aqueous ink adhering thereto to the white ink drying device and a carry-out port for conveying the web-shaped printing base material having the white aqueous ink adhering thereto out from the white ink drying device, and has a drying zone for drying the surface of the web-shaped printing base material having the white aqueous ink adhering thereto, wherein, in the case of back-surface printing, the white aqueous ink is dried by causing the web-shaped printing base material, which has the white aqueous ink adhering thereto and has been conveyed in the forward direction, to pass through the white ink drying device, and wherein, in the case of front-surface printing, the white aqueous ink is dried by causing the web-shaped printing base material, which has the white aqueous ink adhering thereto and has been conveyed in the reverse direction, to pass through the white ink drying device; and with the provided ink jet printer, drying the white aqueous ink to perform front-surface printing with aqueous ink on the web-shaped printing base material by a single-pass system.

* * * * *